US008079577B2

(12) United States Patent
Simon

(10) Patent No.: US 8,079,577 B2
(45) Date of Patent: Dec. 20, 2011

(54) CLAMPING DEVICE

(76) Inventor: Donald Simon, Croydon, PA (US)

( * ) Notice: Subject to any disclaimer, the term of this patent is extended or adjusted under 35 U.S.C. 154(b) by 0 days.

(21) Appl. No.: 12/177,291

(22) Filed: Jul. 22, 2008

(65) Prior Publication Data

US 2010/0019429 A1 Jan. 28, 2010

(51) Int. Cl.
*B25B 5/16* (2006.01)

(52) U.S. Cl. ..... 269/6; 269/3

(58) Field of Classification Search ..... 269/3, 6, 269/95, 166–171.1

See application file for complete search history.

(56) References Cited

U.S. PATENT DOCUMENTS 6,412,767 B1 * 7/2002 Beckmann et al. ..... 269/166
6,585,243 B1 * 7/2003 Li ..... 269/6
6,746,006 B2 * 6/2004 Thomas ..... 269/6
6,889,966 B2 * 5/2005 Wirth et al. ..... 269/6
7,600,744 B2 * 10/2009 Liou ..... 269/166
2010/0019429 A1 * 1/2010 Simon ..... 269/214

* cited by examiner

*Primary Examiner* — Lee D Wilson
(74) *Attorney, Agent, or Firm* — Jerry D. Haynes; The Law Office of Jerry D.Haynes

(57) ABSTRACT

Disclosed is a clamping device for securing and clamping work-piece quickly and efficiently. The clamping device includes an elongated slide bar; a first support assembly and a second support assembly. The first support assembly affixed at a proximal end portion of the elongated slide bar includes a first body portion, and a first clamping member. The second support assembly includes a second body portion, a second clamping member configured on the second body portion, and a locking mechanism configured on the second body portion. The second body portion is slidably coupled to the elongated slide bar for assuming a plurality of positions with respect to the first body portion. The first clamping member and the second clamping member are positioned in a spaced apart relationship for abuttingly clamping the work-piece there between to assume a clamped position of the plurality of positions.

8 Claims, 2 Drawing Sheets

CLAMPING DEVICE

FIELD OF THE INVENTION

The present invention relates generally to hand tools, and, more particularly, to a clamping device capable of clamping a work-piece securely.

BACKGROUND OF THE INVENTION

Clamping devices have been in use since time immemorial. The clamping devices are used primarily to hold a work-piece such as a wood, a metal, a paper, and the like. For example, during woodworking, glue may be applied between pieces of wood for adhesively securing the pieces together. Accordingly, it may be required to hold the pieces of wood together in a secured manner for firmly compressing the pieces of wood while applied glue may be dried.

Currently, work-pieces may be compressed by use of multitudes of clamping devices known in the art such as bar clamping devices, cantilever clamping devices, C-clamping devices, and the like. However, conventional clamping devices lack quick clamping and quick releasing capabilities. A conventional clamping device such as the cantilever clamping device includes a fixed clamping member, a movable clamping member and a threaded rod mechanism. For clamping a work-piece, the work-piece is held between the movable clamping member and the fixed clamping member and the threaded rod mechanism is operated. However, such a process may be time consuming. Further, the conventional clamping devices may not be adapted to clamp work-pieces of different sizes and shapes because of structural limitations thereof.

Furthermore, the movable clamping member and the fixed clamping member of the conventional clamping devices includes an arc-shaped structure which interfere with the correct placement of the work-piece between clamping members of the clamping device and as such complete clamping of the work-piece may be restricted.

Accordingly, there exists a need for a clamping device for quickly and efficiently clamping a work-piece. Further, there exists a need for a clamping device capable of clamping work-pieces irrespective of size and shape thereof. Also, there exists a need for a clamping device which is lightweight, durable, attractive, and incurs low production cost.

SUMMARY OF THE INVENTION

In view of the foregoing disadvantages inherent in the prior art, the general purpose of the present invention is to provide a clamping device configured to include all the advantages of the prior art, and to overcome the drawbacks inherent therein.

Accordingly, an object of the present invention is to provide a clamping device capable of securing and clamping work-piece quickly and efficiently.

Another object of the present invention is to provide a clamping device adaptable to be utilized for clamping work-pieces of a multitude of sizes and shapes.

In light of the above objects, in one aspect of the present invention, a clamping device for clamping a work-piece is provided. The clamping device includes an elongated slide bar; a first support assembly and a second support assembly. The elongated slide bar includes a proximal end portion and a distal end portion. The first support assembly includes a first body portion having a cuboidal shape. The first body portion is affixed at the proximal end portion of the elongated slide bar. The first support assembly further includes a first clamping member extending outwardly from a bottom face of the first body portion. The second support assembly includes a second body portion, a second clamping member configured on the second body portion, and a locking mechanism configured on the second body portion. The second body portion is slidably coupled to the elongated slide bar for assuming a plurality of positions with respect to the first body portion. The locking mechanism is capable of engaging the second body portion with the elongated slide bar for enabling the second clamping member to assume at least one of an unclamped position and a clamped position of the plurality of the positions. More specifically, the first clamping member and the second clamping member are positioned in a spaced apart relationship for abuttingly clamping the work-piece there between to assume the clamped position of the plurality of positions.

This together with other aspects of the present invention, along with the various features of novelty that characterize the present invention, is pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to a particular clamping device, as shown and described. It is understood that various omissions and substitutions of equivalents are contemplated as circumstances may suggest or render expedient, but these are intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a clamping device for clamping a work-piece. The clamping device, as disclosed hereinunder, may be adaptable to be utilized for clamping work-pieces of a multitude of shapes and size. The present invention finds its utility at multitude of place such as home and commercial places and is adapted for use with a wide variety of work-pieces.

Figure 1:
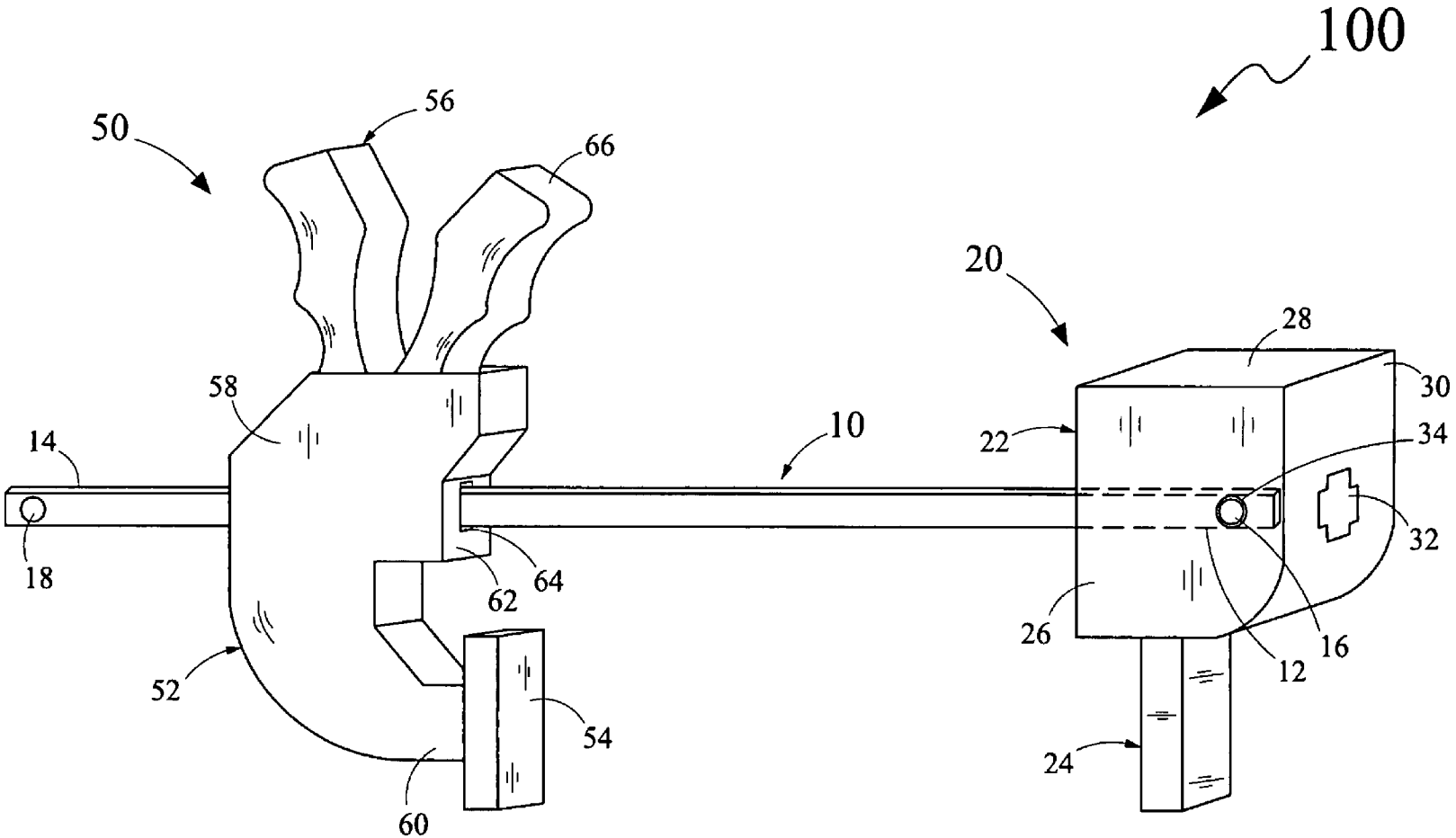
FIG. 1 is a perspective view of a clamping device, in accordance with an embodiment of the present invention.

Referring to FIG. 1, a perspective view of a clamping device 100 capable of clamping a work-piece such as wood piece, metal piece, paper, and the like is illustrated. The clamping device 100 includes an elongated slide bar 10, a first support assembly 20 and a second support assembly 50 slidably coupled to the elongated slide bar 10. The elongated slide bar 10 includes a proximal end portion 12 and a distal end portion 14. The elongated slide bar 10 further includes apertures configured on the proximal end portion 12 and the distal end portion 14. As shown in FIG. 1, the elongated slide bar 10 includes a first aperture 16 configured on the proximal end portion 12 and a second aperture 18 configured on the distal end portion 14. The elongated slide bar 10 is preferably a cuboidal solid bar made of sufficiently rigid material such as steel.

Figure 2:
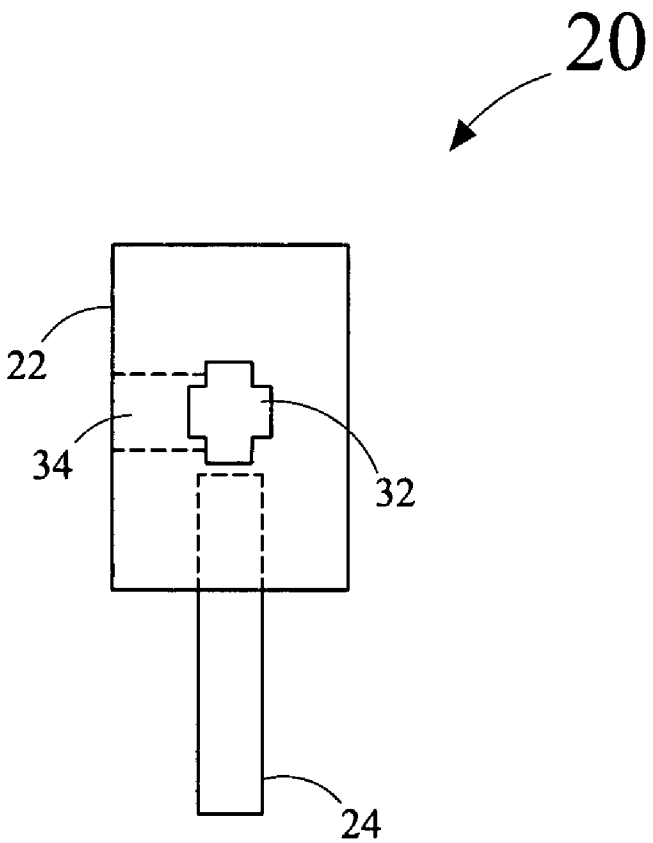
FIG. 2 is a side view of a first support assembly of the clamping device of FIG. 1, in accordance with an embodiment of the present invention.

The first support assembly 20 includes a first body portion 22, and a first clamping member 24 configured on the first body portion 22. In an embodiment of the present invention, the first body portion 22 is configured to have a cuboidal shape. However it will be evident to a person skilled in the art that the first body portion 22 may be configured to have any other suitable shape, such as a cubical shape and the like. Further, the first body portion 22 is made of a lightweight sturdy material such as a metal or a plastic. The first body portion 22 includes a front face 26, a rear face (not shown), an upper face 28, a bottom face (not shown), a first side face (not shown), and a second side face 30 configuring a cuboidal shaped structure of the first body portion 22, in accordance with an embodiment of the present invention. The first body portion 22 further includes a first groove 32 extending substantially along a length of the first body portion 22. More specifically, the first groove 32 extends longitudinally from the first side face to the second side face 30. The first groove 32 is configured to receive the proximal end portion 12 of the elongated slide bar 10. Accordingly, the first support assembly 20 is coupled to the elongated slide bar 10. The front face 26 of the first body portion 22 includes an orifice 34 extending up to the first groove 32, as shown in FIG. 2. The orifice 34 is configured to receive a fastening member (not shown) such as a screw therewithin to securely hold the elongated slide bar 10 received within the first groove 32 of the first body portion 22.

More specifically, the proximal end portion 12 of the elongated slide bar 10 is received within the first groove 32 of the first body portion 22 in a manner such that the first aperture 16 of the proximal end portion 12 is aligned with the orifice 34 of the first body portion 22. Thereafter, the elongated slide bar 10 is coupled to the first body portion 22 by means of the fastening member such as the screw received in the first aperture 16 through the orifice 34. The second aperture 18 of the distal end portion 14 may be adapted to function as a stopper by receiving a restricting means such as a screw, a metal rod and the like. It will be evident to a person skilled in the art that the attachment of the elongated slide bar 10 within the first body portion 22 may take place with any end of the elongated slide bar 10 such as the proximal end portion 12 or the distal end portion 14 and the attachment of the proximal end portion 12 within the first body portion 22 is set forth herein for purposes of illustration only and may not be construed as limiting.

The first clamping member 24 is configured on the bottom face of the first body portion 22 in a manner such that the first clamping member 24 is perpendicular to the first groove 32. More specifically, the first clamping member 24 extends outwardly from the bottom face of the first body portion 22, as shown in FIG. 1. In an embodiment of the present invention, the first clamping member 24 extends into the first body portion 22, as shown in FIG. 2. The first clamping member 24 is preferably a rectangular solid rod formed of sufficiently rigid material, such as metal, plastic, and the like. It will be apparent to those skilled in the art that the appearance and structural configuration of the first body portion 22 and the first clamping member 24 as set forth herein is for purposes of illustration only and that the present invention is not limited to the appearance and the structural configuration of the first body portion 22 and the first clamping member 24 as described herein. Further, the first groove 32 of the first body portion 22 includes securement elements (not shown) such as a roll pin for securement of the elongated slide bar 10 within the first body portion 22.

The second support assembly 50 of the clamping device 100 includes a second body portion 52, a second clamping member 54 configured on the second body portion 52, and a locking mechanism 56 configured on the second body portion 52. The locking mechanism 56 and the second clamping member 54 are configured on opposite ends of the second body portion 52. The second body portion 52 and the locking mechanism 56 may be configured from a rigid but light weight material such as plastic. The second clamping member 54 is preferably a rectangular block of sufficiently rigid material such as steel and the like. The second body portion 52 may have any polygonal shape as shown in FIG. 1. The second body portion 52 includes a main body portion 58 and an arm portion 60 extending outwardly from the main body portion 58 in a perpendicular direction (shown in FIG. 1) to the main body portion 58. The second clamping member 54 is configured on the arm portion 60 of the second body portion 52. The main body portion 58 of the second body portion 52 is configured to house the locking mechanism 56. Further, the main body portion 58 includes a front side 62 and a rear side (not shown). A second groove 64 is configured within the main body portion 58. More specifically, the second groove 64 extends from the front side 62 to the rear side. The second groove 64 is readily adaptable to receive the elongated slide bar 10, as shown in FIG. 1, thereby slidably coupling the second body portion 52 of the second support assembly 50 to the elongated slide bar 10. In use, the second support assembly 50 and the first support assembly 20 are configured on the elongated slide bar 10 in a manner such that the first clamping member 24 of the first support assembly 20 and the second clamping member 54 of the second support assembly 50 are parallel and disposed in opposing relation to each other.

Further, the second support assembly 50 is capable of sliding on the elongated slide bar 10 for assuming a plurality of positions with respect to the first body portion 22 of the first support assembly 20. More specifically, the locking mechanism 56 is configured to enable the second body portion 52 to slide on the elongated slide bar 10 to move the second clamping member 54 towards and away from the first clamping member 24. The second body portion 52 of the second support assembly 50 is capable of assuming at least one of an unclamped position and a clamped position of the plurality of the positions. In the clamped position, the first clamping member 24 and the second clamping member 54 are positioned in a spaced apart relationship for abuttingly clamping a work-piece (not shown) therebetween. It will be evident to a person skilled in the art that the clamped position of the second body portion 52 may also be described as the clamped position of the second support assembly 50. Accordingly, the term "clamped position" has been interchangeably used with reference to both the second body portion 52 and the second support assembly 50. Further, the second clamping member 54 may be slid away from the first clamping member 24, thereby configuring a space therebetween to configure the unclamped position of the plurality of positions.

The locking mechanism 56 may be any locking mechanism known in the art for allowing the second support assembly 50 to slide on the elongated slide bar 10. The locking mechanism 56 is further adapted to secure the second support assembly 50 at a position on the elongated slide bar 10 when a desired separation between the first clamping member 24 and the second clamping member 54 has been achieved for abuttingly clamping a work-piece therebetween. In the present embodiment, the locking mechanism 56, as shown in FIG. 1, includes a gripping portion 66 and a resilient member (not shown) configured within the second support assembly 50. The gripping portion 66 is configured to operate the resilient member in order to selectively move or to secure the second support assembly 50 on the elongated slide bar 10. It will be evident to a person skilled in the art that the structural configuration of the locking mechanism 56 as set forth herein is for purposes of illustration only and may not be construed as limiting.

In use, the first support assembly 20 is securely coupled with the elongated slide bar 10. More specifically, the proximal end portion 12 of the elongated slide bar 10 is received within the first groove 32 and is secured by means of the fastening means such as the screw. The second support assembly 50 is slidably coupled to the elongated slide bar 10 in a manner such that the first clamping member 24 and the second clamping member 54 are in opposing relation to each other. For clamping the work-piece, the second support assembly 50 is slid on the elongated slide bar 10 towards the first support assembly 20 to assume a clamped position. More specifically, the locking mechanism 56 capable of sliding the second support assembly 50 on the elongated slide bar 10 brings the first clamping member 24 and the second clamping member 54 in a spaced relationship for abuttingly clamping the work-piece therebetween to assume the clamped position. For releasing the work-piece, the gripping portion 66 is enabled to operate the resilient member for releasing the second support assembly 50 from the clamped position. Thereafter, the second support assembly 50 is slid on the elongated slide bar 10 away from the first support assembly 20 to assume the unclamped position, thereby releasing the work-piece.

It will be evident to a person skilled in the art that the clamping device 100 may have multitude of sizes and structural configuration and the present embodiment as explained herein in conjunction with FIGS. 1 and 2 is set forth for purposes of illustration only and may not be construed as limiting. The length of the elongated slide bar 10 may vary, however, in a preferred embodiment of the present invention, the elongated slide bar 10 is of a sufficient length to allow the first support assembly 20 and the second support assembly 50 to have a maximum spread of about 13½ inches therebetween so that sufficient space is available for clamping of work-pieces of different dimensions. In an embodiment of the present invention, a length of the first body portion 22 between the first side face to the second side face 30 may be about 2½ inches and the width of the first body portion 22 may be about 2½ inches.

As explained in conjunction with FIG. 1, a clamping device, such as the clamping device 100, may be used for clamping of work-pieces of different dimensions with ease and in the most efficient manner. The clamping device 100 of the present invention may be advantageously used to securely hold a work-piece or a plurality of work-pieces together while a user is working thereon. Accordingly, the clamping device 100 prevents movement of the work-piece due to application of pressure on the work-piece while the user is working thereon. The structural configuration of the clamping device 100 provides for clamping of the work-piece without causing any interference between various components of the clamping device 100 and the work-piece thereby enabling easy and quick clamping of the work-piece.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present invention.

What is claimed is:

1. A clamping device for clamping a work piece, a clamping device comprising: an elongated slide bar, the elongated slide bar having a proximal end portion and a distal end portion;

a first support assembly, the first support assembly comprising, a first body portion having a cuboidal shape, a first body portion affixed at the proximal end portion of the elongated slide bar, and a first clamping member extending from inside the first body portion then outwardly from a bottom face of the first body portion; and a second support assembly, the second support assembly comprising, a second body portion, the second body portion slidably coupled to the elongated slide bar for assuming a plurality of positions with respect to the first body portion, where the second body portion includes a main body portion and an arm portion extending outwardly from the main body in a perpendicular direction to the main body portion, a second clamping member configured on the arm portion of the second body portion, and a locking mechanism housed in the main body portion, where the locking mechanism includes a gripping portion and a resilient member configured within the second body portion, where the gripping portion operates the resilient member to move the second body portion along the elongated slide bar thereby moving the second clamping member towards and away from the first clamping member, wherein the locking mechanism is capable of engaging the second body portion with the elongated slide bar for movement of the second body portion with respect to the first body portion for enabling the second body portion to assume at least one of an unclamped position and a clamped position of the plurality of the positions, wherein the first clamping member and the second clamping member are positioned in a spaced apart relationship for abutting clamping the work piece there between to assume the clamped position of the plurality of positions, and wherein the gripping portion operates the resilient member to release the second clamping member from the clamped position.

2. The clamping device of claim 1, wherein the first body portion comprises a first groove extending substantially through a length of the first body portion for receiving the proximal end portion of the elongated slide bar.

3. The clamping device of claim 1, wherein the second body portion comprises a second groove extending substantially through a length of the second body portion to allow the elongated slide bar to pass there through.

4. The clamping device of claim 1, wherein the first clamping member is cuboidal in shape.

5. The clamping device of claim 1 wherein the first body portion is composed of a plastic material.

6. The clamping device of claim 1, wherein the first clamping member is composed of a steel material.

7. The clamping device of claim 1 wherein the elongated slide bar is composed of steel.

8. A clamping device for clamping a work piece, a clamping device comprising:

an elongated slide bar, the elongated slide bar having a proximal end portion and a distal end portion;

a first body portion, where the first body portion is affixed at the proximal end portion of the elongated slide bar;

a first clamping member extends from inside the first body portion and then outwardly from a bottom face of the first body portion;

a first groove extending substantially through a length of the first body portion for receiving the proximal end portion of the elongated slide bar;

a second body portion, the second body portion slidably coupled to the elongated slide bar for assuming a plurality of positions with respect to the first body portion, where the second body portion includes a main body portion and an arm portion extending outwardly from the main body in a perpendicular direction to the main body portion;

a second clamping member configured on the arm portion of the second body portion;

a second groove extending substantially through a length of the second body portion to allow the elongated slide bar to pass there through; and a locking mechanism housed in the second body portion, where the locking mechanism includes a resilient member and a gripping portion configured within the second body portion wherein the gripping portion operates the resilient member to engage the second body portion with the elongated slide bar thereby moving the second body portion and the second clamping member towards and away from the first body portion for enabling the second body portion to assume at least one of an unclamped position and a clamped position from a plurality of positions, wherein the griping portion operates the resilient member to release the second body portion from the clamped position, and wherein the first clamping member and the second clamping member are positioned in a spaced apart relationship for abutting clamping the work piece there between to assume the clamped position from the plurality of positions.

* * * * *